US009913045B2

(12) United States Patent
Hooton et al.

(10) Patent No.: US 9,913,045 B2
(45) Date of Patent: Mar. 6, 2018

(54) PIEZOELECTRIC SPEAKERS FOR ELECTRONIC DEVICES

(71) Applicant: APPLE INC., Cupertino, CA (US)

(72) Inventors: Lee E. Hooton, New York, NY (US); Robert F. Meyer, Palo Alto, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 15/132,136

(22) Filed: Apr. 18, 2016

(65) Prior Publication Data

US 2017/0303048 A1 Oct. 19, 2017

(51) Int. Cl.

| | |
|---|---|
| ***H04R 25/00*** | (2006.01) |
| ***H04R 17/00*** | (2006.01) |
| ***H04R 1/22*** | (2006.01) |
| ***H04R 7/18*** | (2006.01) |
| ***H04R 7/04*** | (2006.01) |

(52) U.S. Cl.

CPC ..... *H04R 17/005* (2013.01); *H04R 1/227* (2013.01); *H04R 7/04* (2013.01); *H04R 7/045* (2013.01); *H04R 7/18* (2013.01); *H04R 2307/201* (2013.01); *H04R 2499/11* (2013.01); *H04R 2499/15* (2013.01)

(58) Field of Classification Search

CPC ..... H04R 7/045; H04R 7/18; H04R 17/00; H04R 17/005; H04R 17/06; H04R 2217/01; H04R 2499/11; H04R 2499/15; H04R 7/04; H04R 17/10; H04R 2307/20; H04M 1/03

USPC ..... 381/306, 333, 152, 173, 388, 189, 190, 381/191, 398, 431; 310/322, 324, 328, 310/345

See application file for complete search history.

(56) References Cited

U.S. PATENT DOCUMENTS

| | | | | |
|---|---|---|---|---|
| 5,118,981 A * | 6/1992 | Kobayashi | B60G 17/01941 | 310/324 |
| 6,427,017 B1 * | 7/2002 | Toki | B06B 1/0688 | 181/170 |
| 7,151,837 B2 * | 12/2006 | Bank | H04R 7/045 | 381/152 |
| 7,382,890 B2 * | 6/2008 | Saiki | H04R 7/04 | 381/152 |

* cited by examiner

*Primary Examiner* — Huyen D Le
(74) *Attorney, Agent, or Firm* — Kilpatrick Townsend and Stockton, LLP

(57) ABSTRACT

An electronic device has an exterior housing with a piezoelectric speaker disposed in an opening formed within the housing. The piezoelectric speaker includes a speaker diaphragm that is secured within the opening with a vibration isolator. The vibration isolator allows the diaphragm to vibrate independently from the housing.

23 Claims, 5 Drawing Sheets

Section A-A

View B

View B

Section C-C

PIEZOELECTRIC SPEAKERS FOR ELECTRONIC DEVICES

FIELD

The described embodiments relate generally to electronic devices that employ speakers within an exterior housing of an electronic device. More particularly, the present embodiments relate to piezoelectric speakers that are used in electronic devices.

BACKGROUND

Currently there are a wide variety of electronic devices that include one or more speakers located within their exterior housings. Many of these electronic devices employ traditional voice coil speakers that involve relatively large and complex assemblies. However, electronic devices are becoming smaller and more feature rich, leaving less room for the relatively large and complex voice coil speakers.

SUMMARY

Some embodiments of the present disclosure relate to piezoelectric speakers and to electronic devices that include such speakers. Piezoelectric speakers according to embodiments of the disclosure can be relatively thin compared to traditional voice coil speakers, which in turn, allows devices that incorporate such piezoelectric speakers to be made smaller and/or enables the devices to have extra room for additional components.

In some embodiments an electronic device according to the disclosure includes a housing having an exterior surface with an opening formed there through. A piezoelectric speaker, including a diaphragm and a piezoelectric receiver, is aligned with and fit within the opening. A vibration isolator is coupled between the piezoelectric speaker diaphragm and the housing to enable the piezoelectric speaker diaphragm to vibrate independently from the housing.

In some embodiments the vibration isolator is disposed around a periphery of the speaker diaphragm and creates a water tight seal between the speaker diaphragm and the housing. In various embodiments the piezoelectric speaker diaphragm is coplanar with and colored to match the exterior surface of the housing such that it appears to be a portion of the housing. In some embodiments a plurality of piezoelectric speakers are used together to create an aggregate speaker with improved sound quality as compared to a unitary piezoelectric speaker.

In some embodiments the piezoelectric speaker diaphragm is made from a transparent material and in various embodiments the diaphragm and the housing are both made from a transparent material. In some embodiments circuitry is operatively coupled to the piezoelectric receiver and is configured to cause the piezoelectric speaker diaphragm to vibrate and function as a speaker.

In some embodiments an electronic device according to the disclosure includes a transparent cover disposed over a graphical display of the electronic device. The transparent cover has an opening formed there through and a piezoelectric speaker is aligned with the opening. The piezoelectric speaker can include a speaker diaphragm and a piezoelectric receiver attached to the speaker diaphragm. A vibration isolator is coupled between the speaker diaphragm and the transparent cover to enable the speaker diaphragm to vibrate independently from the transparent cover.

In some embodiments the speaker diaphragm is made from a transparent material and is coplanar with the transparent cover. In various embodiments the piezoelectric receiver includes a layer of piezoelectric material bonded to the speaker diaphragm. In some embodiments the vibration isolator is arranged to cover a gap between the speaker diaphragm and the transparent cover creating a water tight seal between the speaker diaphragm and the transparent cover.

In some embodiments a plurality of vibration isolators are disposed around a periphery of the speaker diaphragm. In various embodiments there are a plurality of speakers used together to create an aggregate speaker with improved sound quality. Each of the plurality of speakers can each have a separate diaphragm aligned with an opening within the transparent cover. In some embodiments circuitry is operatively coupled to the piezoelectric receiver and is configured to cause the piezoelectric speaker diaphragm to vibrate and function as a speaker.

In some embodiments an electronic device includes a housing having an exterior surface with an opening formed there through. A piezoelectric speaker is aligned with the opening and includes a piezoelectric receiver attached to the speaker diaphragm. A speaker driver circuit is configured to transmit electronic signals to the piezoelectric speaker receiver that make the speaker diaphragm vibrate. A vibration isolator is coupled between the piezoelectric speaker diaphragm and the housing to enable the piezoelectric speaker diaphragm to vibrate independently from the housing.

In some embodiments the vibration isolator is arranged to cover a gap between the speaker diaphragm and the housing to create a water tight seal between the speaker diaphragm and the housing. In various embodiments the piezoelectric speaker diaphragm is coplanar with and colored to match the exterior surface of the housing such that it appears to be a portion of the housing. In some embodiments the piezoelectric speaker diaphragm is made from a transparent material.

In some embodiments the housing is made from a transparent material. In various embodiments there are a plurality of speaker diaphragms, each aligned with an opening within the housing.

To better understand the nature and advantages of the present disclosure, reference should be made to the following description and the accompanying figures. It is to be understood, however, that each of the figures is provided for the purpose of illustration only and is not intended as a definition of the limits of the scope of the present disclosure. Also, as a general rule, and unless it is evident to the contrary from the description, where elements in different figures use identical reference numbers, the elements are generally either identical or at least similar in function or purpose.

DETAILED DESCRIPTION

Some embodiments of the present disclosure relate to piezoelectric speakers that are used in electronic devices. For example, in some embodiments an electronic device, such as a smartphone, is equipped with a piezoelectric speaker that is used as a phone receiver. The electronic device has an exterior housing with an opening that is configured to receive the piezoelectric speaker. The piezoelectric speaker has a diaphragm that is aligned with the opening and coplanar with an exterior surface of the housing. A vibration isolator is used to secure the diaphragm to the housing and to isolate the diaphragm from the housing so the diaphragm can vibrate independently from the housing. A piezoelectric receiver, comprising piezoelectric material, is attached to an interior surface of the diaphragm and is driven by circuitry within the electronic device. The circuitry within the electronic device supplies electronic signals to the piezoelectric receiver which moves in response, causing the diaphragm to vibrate, creating sound waves the user can hear. The piezoelectric speaker is relatively thin as compared to traditional voice coil speakers, consuming relatively little space within the electronic device.

In some embodiments, the vibration isolator can be configured to form a watertight seal between the diaphragm and the housing so liquid and/or debris cannot pass into the electronic device through the opening in the housing. In various embodiments the diaphragm can be made out of the same material as the housing (e.g., glass, zirconia, aluminum, steel, etc.) and formed to be nearly imperceptible from the remainder of the housing, providing an aesthetically appealing continuous exterior housing.

In another example a combination of different sizes and/or shapes of piezoelectric speakers can be used together to improve the sound quality of the aggregated speaker. In a further example, a piezoelectric receiver can be mounted to a portion of the electronic device housing so the housing functions as the speaker diaphragm.

In order to better appreciate the features and aspects of piezoelectric speakers for electronic devices according to the present disclosure, further context for the disclosure is provided in the following section by discussing one particular implementation of an electronic device according to embodiments of the present disclosure. These embodiments are for example only and other embodiments can be employed in other electronic devices such as, but not limited to computers, watches, wearable electronic devices, media players and other devices.

Figure 1:
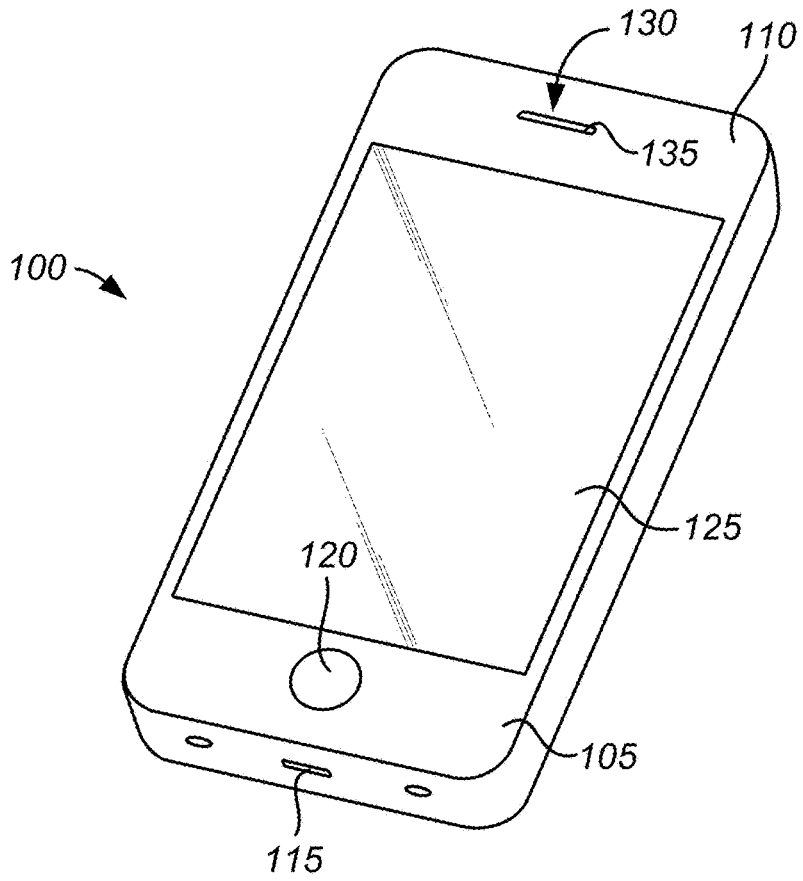
FIG. 1 is a front perspective view of an electronic device according to an embodiment of the invention.

FIG. 1 depicts an illustrative rendering of an electronic device 100, such as a smart phone, according to some embodiments of the disclosure. Electronic device 100 includes a housing 105 having an exterior surface 110, a receptacle connector 115, a multipurpose button 120 as an input component and a touch screen display 125 as both an input and output component. Housing 105 may include a transparent cover made from a transparent ceramic, glass or plastic material as a front portion of the housing and the remainder of the housing may be made from a different material such as, for example, metal or plastic. Electronic device 100 also includes a phone receiver 130 including one or more piezoelectric speakers 135, as described in greater detail below.

Figure 2:
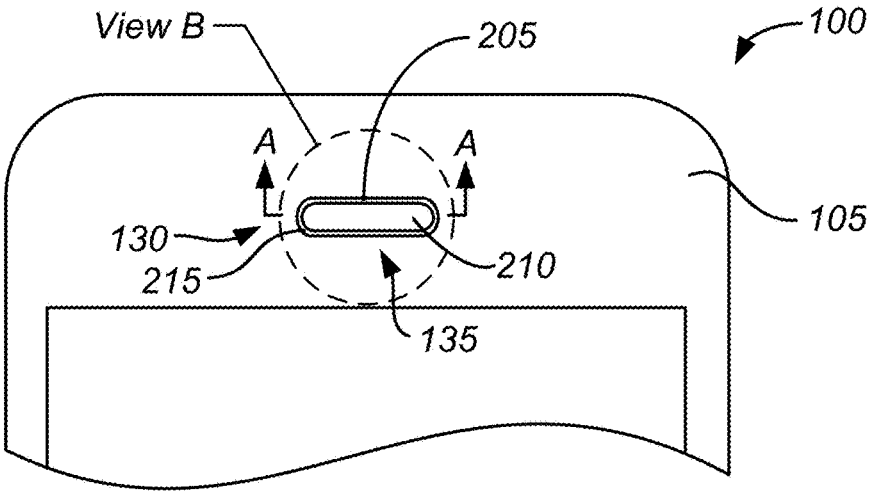
FIG. 2 is a close up view of a top portion of the electronic device shown in FIG. 1.

Now referring to FIG. 2 a magnified view of a top portion of electronic device 100, including phone receiver 130 is illustrated. As shown in FIG. 2, phone receiver 130 includes a receiver opening 205 formed through housing 105. A diaphragm 210 of piezoelectric speaker 135 is aligned with and fit into the opening. In some embodiments diaphragm 210 can have a similar appearance as housing 105 and a gap 215 between the diaphragm and housing 105 can be relatively small such that the diaphragm is nearly imperceptible from the housing, providing an aesthetically appealing continuous exterior housing, as discussed in more detail below. Section A-A through receiver opening 205, speaker diaphragm 210 and other components within housing 105 is illustrated in FIG. 3.

Figure 3:
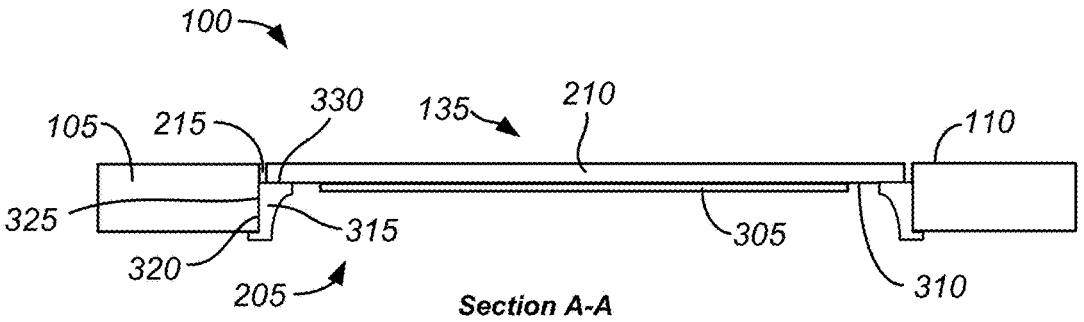
FIG. 3 is a partial cross-sectional view of the receiver speaker shown in FIG. 2.

As shown in FIG. 3 receiver opening 205 is formed through the entire thickness of housing 105 and piezoelectric speaker 135 is fit within the opening. More specifically, piezoelectric speaker 135 includes a piezoelectric speaker diaphragm 210 with a piezoelectric receiver 305 bonded to it. Speaker diaphragm 210, which can include a substantially flat and thin high modulus of elasticity material, is aligned with opening 205 and positioned substantially flush with exterior surface 110 of housing 105. Piezoelectric receiver 305, which can include a substantially flat and thin piece of piezoelectric material sized slightly smaller than speaker diaphragm 210, is attached to an interior surface 310 of speaker diaphragm 210. A vibration isolator 315 is coupled between piezoelectric speaker diaphragm 210 and housing 105 to hold piezoelectric speaker 135 in place within opening 205 and to isolate the diaphragm from the housing, as described in more detail below.

Piezoelectric speaker 135 functions by receiving electronic signals from circuitry within electronic device 100. More specifically, piezoelectric receiver 305 is made from a piezoelectric material that moves in response to receiving electronic signals. When piezoelectric receiver 305 moves (i.e., vibrates) it makes diaphragm 210 vibrate which creates sound waves that can be heard by a user.

In some embodiments diaphragm 210 can be arranged to be coplanar with and colored to match exterior surface 110 of housing 105 such that the diaphragm appears to be a portion of the housing, giving electronic device 100 an aesthetically appealing appearance. For example, in some embodiments housing 105 may have a front portion (also called a transparent cover) made from a transparent material, such as, for example, glass, sapphire, silicon dioxide or zirconia, and diaphragm 210 is made from the same or a similar looking material. In another example, housing 105 is made from a metal, such as aluminum or steel, and diaphragm 210 is made from the same or a similar looking material. As discussed above, housing 105 may have a transparent cover disposed over all of or a portion of the housing and the remainder of the housing may be made from a different material such as metal and/or plastic. These materials are for example only and other materials can be used for housing 105 and diaphragm 210 without departing from the disclosure. In some embodiments diaphragm 210 may be made from a relatively high modulus of elasticity material that can be above 25 GPa, while in various embodiments it can be above 50 GPa.

In some embodiments, diaphragm 210 can be made to look like a portion of housing 105 by minimizing gap 215 between diaphragm 210 and housing 105. In various embodiments gap 215 can be between 5 microns and 1500 microns while in other embodiments it can be between 5 microns and 100 microns and in some embodiments it can be between 10 microns and 50 microns.

In some embodiments piezoelectric receiver 305 includes a piezoelectric crystalline, polycrystalline material such as, for example: quartz, berlinite, sucrose, topaz, tourmaline, Rochelle salt, barium titanate (BaTiO3), lead zirconate titanate (PZT), potassium niobate (KNbO3), sodium tungstate (Na2WO3), Ba2NaNb5O5, Pb2KNb5O15, Zinc oxide (ZnO)-Wurtzite structure and Group III-V and II-VI materials, or other material.

In some embodiments, vibration isolator 315 is made from a material that enables piezoelectric speaker diaphragm 210 to vibrate independently from housing 105. More specifically, in some embodiments when piezoelectric diaphragm 210 vibrates to generate sound waves, it may be desirable to isolate the diaphragm from surrounding housing 105 so the housing does not also vibrate and broadcast the sound (i.e., acting as a loudspeaker). By isolating the vibrations to diaphragm 210, a user may be able to privately hear sound from the diaphragm by placing their ear over the diaphragm (i.e., over phone receiver 130 in FIG. 1). Further, vibration isolator 315 can also improve the acoustic performance of piezoelectric speaker 135 by allowing the majority of the vibrational energy from piezoelectric receiver 305 to be used to make diaphragm 210 vibrate and not be damped or dissipated by housing 105.

In some embodiments vibration isolator 315 can be made out of a relatively low modulus of elasticity elastic material, such as, for example: a silicone, a rubber, or an elastomer while other embodiments can be made out of a flexible membrane such as, for example, Mylar, polyamide, or other material. Vibration isolator 315 can be secured to diaphragm 210 and/or housing 105 by the adhesion of the isolator material itself, or with the aid of other materials like an adhesive or a heat activated film. Similar materials can be used to adhere piezoelectric receiver 305 to diaphragm 210. Myriad materials can be used for vibration isolator 315 and for the adhesion of the isolator without departing from the disclosure.

In the embodiment illustrated in FIG. 3, vibration isolator 315 has an outer surface 320 that is secured to a wall 325 of opening 205 and an upper surface 330 that is secured to interior surface 310 of diaphragm 210, however other embodiments can have vibration isolators that are secured to piezoelectric speaker 135 in a different way.

Figure 4:
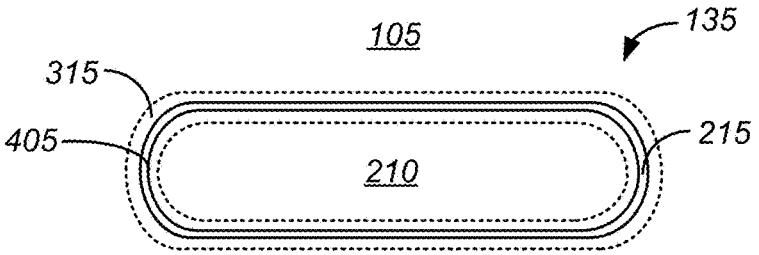
FIG. 4 is a close up view of the receiver speaker of the electronic device shown in FIG. 2.

Now referring to FIG. 4 a close-up plan view of piezoelectric speaker 135 is shown with the dashed lines indicating the planar location of vibration isolator 315. In this embodiment a single vibration isolator 315 is disposed around an entire periphery 405 of speaker diaphragm 210 and can be configured to create a water tight seal between the speaker diaphragm and housing 105, however other embodiments of the disclosure can include different configurations for the vibration isolator.

Figure 5:
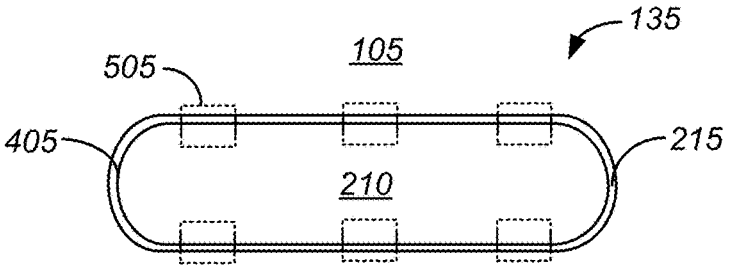
FIG. 5 is a close up view of an alternative embodiment of the receiver speaker of the electronic device shown in FIG. 2.

For example, referring to FIG. 5, in some embodiments there can be a plurality of individual vibration isolators 505 that are disposed around periphery 405 of speaker diaphragm 210. In the embodiment illustrated in FIG. 5 there are six individual vibration isolators 505, however other embodiments can have less or more individual isolators that may be arranged or configured differently than illustrated.

Figure 6:
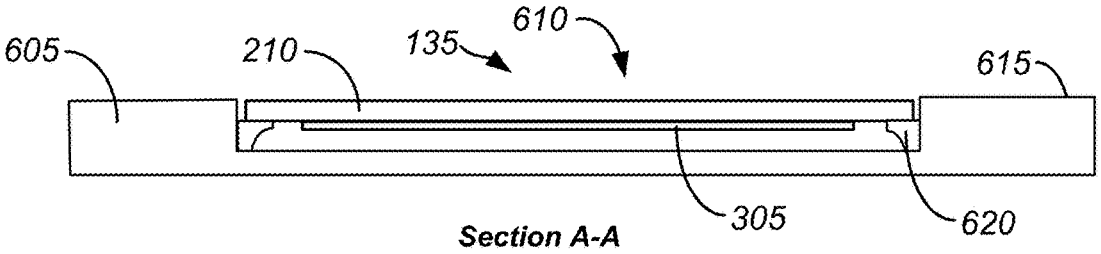
FIG. 6 is a partial cross-sectional view of an alternative embodiment of the receiver speaker shown in FIG. 2.

Now referring to FIG. 6, a cross-section of a piezoelectric speaker 135 is illustrated according to another embodiment of the disclosure. The embodiment shown in FIG. 6 differs from the embodiment discussed above in that a housing 605 of an electronic device includes an opening 610 that does not penetrate the entire thickness of the housing. Rather, opening 610 is a recess that is formed in an outer surface 615 of housing 605. This embodiment has the benefit of a waterproof housing 605 without relying on vibration isolator 620 to provide a seal. Thus, this embodiment can be used with a plurality of individual vibration isolators, such as those described above in FIG. 5, without adversely affecting the waterproof performance of the electronic device.

In some embodiments, electronic signals can be coupled to receiver 305 with, for example, wires, a flexible circuit board or conductive traces that could be formed with insert molding or laser direct structuring. In embodiments where opening 610 is formed in a portion of housing 605 that is a transparent cover, conductive traces may be routed on the inside surface of the transparent cover and conductive vias can transition electrical signals within the recess where wires or a flexible circuit board can couple the electronic signals to the piezoelectric receiver. In some embodiments the traces and vias can be formed with printable metallic inks having a glass frit such as those used with ceramics. In other embodiments the traces and vias can be formed with a thin film process, such as electroplating or sputtering and patterned with photolithography. Other methods can be used without departing from this disclosure.

Figure 7:
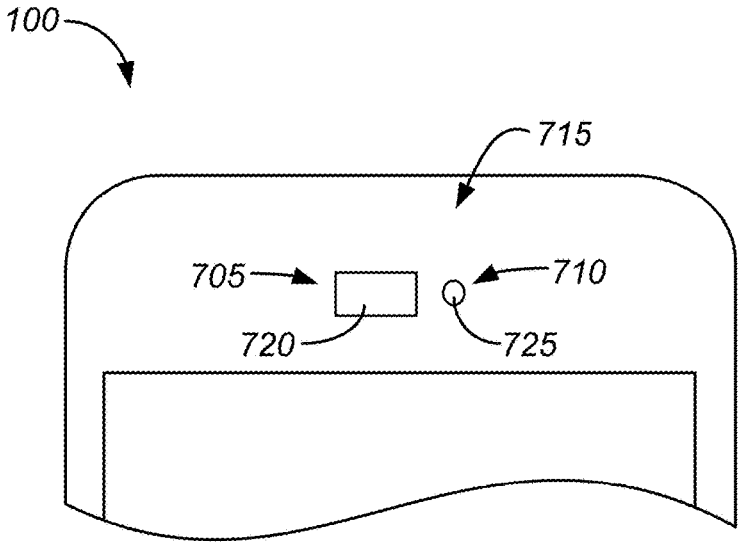
FIG. 7 is a close up view of a top portion of an electronic device with two receiver speakers according to an embodiment of the invention.

Now referring to FIG. 7 an embodiment of electronic device 100 is illustrated that uses two separate piezoelectric speakers 705, 710 for phone receiver 715. Using more than one piezoelectric speaker can enable the combination of speakers to, for example, improve the sound quality of receiver 715 and/or simultaneously generate audio for a user while generating active noise cancellation sounds or for other functions. In this embodiment, left speaker 705 has a relatively larger rectangular diaphragm 720 and right speaker 710 has a relatively smaller circular diaphragm 725, however other embodiments can employ a greater number of piezoelectric speakers having diaphragms of any size and shape. As an example, left speaker 705 can use larger diaphragm 720 to generate lower frequency audio signals while right speaker 710 can use smaller diaphragm 725 to generate higher frequency audio signals. Thus, the combination of speakers 705, 710 can be used in aggregate to improve audio quality of phone receiver 715.

Figure 8:
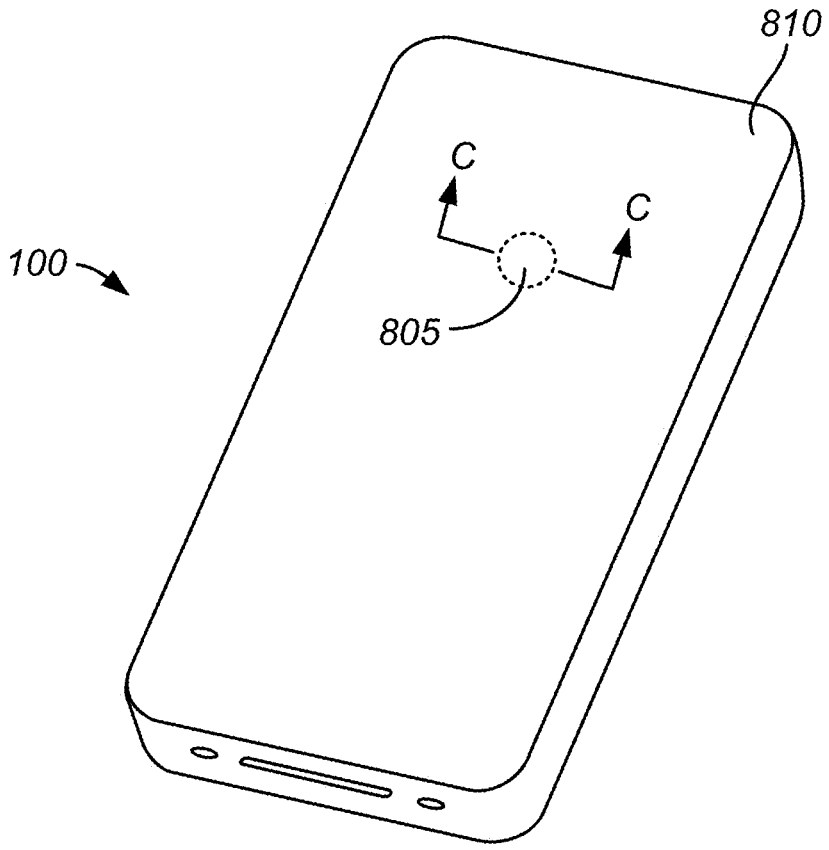
FIG. 8 is a rear perspective view of an electronic device with a piezoelectric loudspeaker according to an embodiment of the invention.
Figure 9:
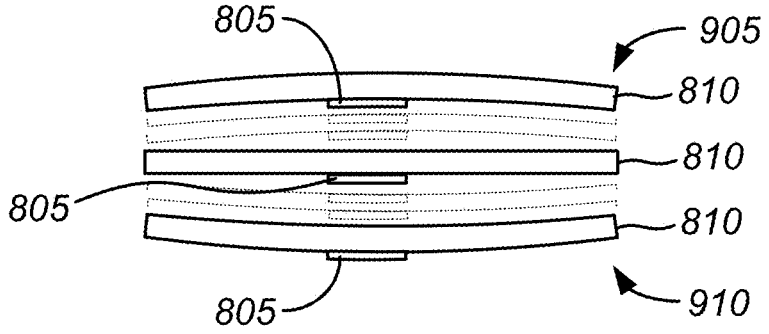
FIG. 9 is a partial cross-sectional view of the loudspeaker shown in FIG. 8.

Now referring to FIG. 8, an isometric rear view of electronic device 100 is illustrated. In this embodiment a piezoelectric receiver 805 is secured to an inside surface of rear housing 810 such that a portion of the housing acts as the speaker diaphragm. As compared to the embodiments above, this embodiment can generate louder sounds (i.e., due to the larger diaphragm) and could be used as a loudspeaker or other function such as, for example, tactile feedback to a user. FIG. 9 illustrates cross-section C-C through piezoelectric receiver 805 and rear housing 810. FIG. 9 also illustrates an exaggerated upper range of motion 905 and a lower range of motion 910 for a portion of rear housing 810 when piezoelectric receiver 805 makes the rear housing vibrate and generate sound waves. The location at which piezoelectric receiver 805 is mounted to housing 810 in FIG. 8 is just one example of a suitable mounting location. In other embodiments of the disclosure piezoelectric receiver 805 can be mounted to the electronic device housing at other locations. Further, the particular portion of housing 810 that piezoelectric receiver 805 is mounted to can be any material including a transparent material including glass or ceramic, a metal or a plastic.

Figure 10:
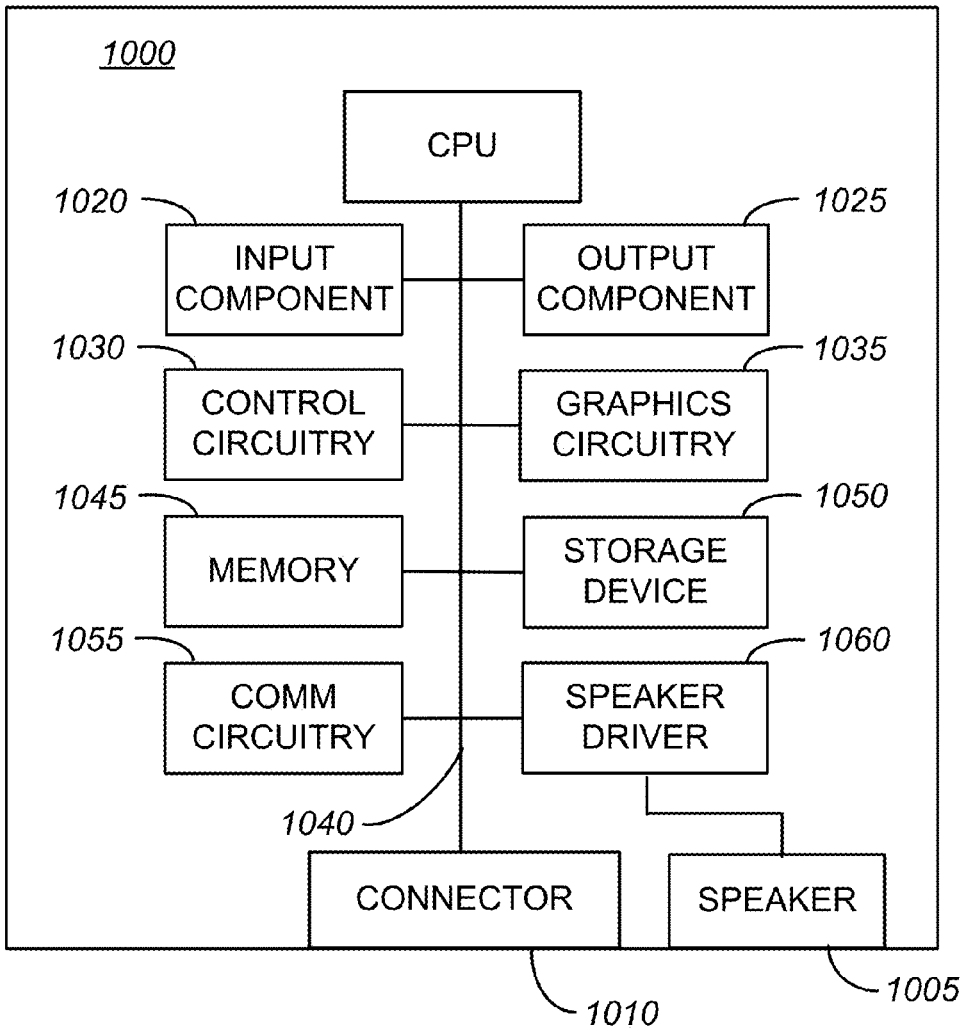
FIG. 10 is a simplified system diagram of an electronic device with a speaker according to an embodiment of the invention.

Now referring to FIG. 10 a simplified illustrative block diagram representing an electronic media device 1000 (e.g., such as device 100 in FIG. 1) that includes a piezoelectric speaker 1005 according to embodiments of the present disclosure is illustrated. Electronic media device 1000 can also include, among other components, connector receptacle 1010, one or more user input components 1020, one or more output components 1025, control circuitry 1030, graphics circuitry 1035, a bus 1040, a memory 1045, a storage device 1050, communications circuitry 1055 and speaker driver circuitry 1060. Control circuitry 1030 can communicate with the other components of electronic media device 1000 (e.g., via bus 1040) to control the operation of electronic media device 1000. In some embodiments, control circuitry 1030 can execute instructions stored in a memory 1045. Control circuitry 1030 can also be operative to control the performance of electronic media device 1000. Control circuitry 1030 can include, for example, a processor, a microcontroller and a bus (e.g., for sending instructions to the other components of electronic media device 1000). In some embodiments, control circuitry 1030 can also drive the display and process inputs received from input component 1020.

Memory 1045 can include one or more different types of memory that can be used to perform device functions. For example, memory 1045 can include cache, flash memory, ROM, RAM and hybrid types of memory. Memory 1045 can also store firmware for the device and its applications (e.g., operating system, user interface functions and processor functions). Storage device 1050 can include one or more suitable storage mediums or mechanisms, such as a magnetic hard drive, flash drive, tape drive, optical drive, permanent memory (such as ROM), semi-permanent memory (such as RAM) or cache. Storage device 1050 can be used for storing media (e.g., audio and video files), text, pictures, graphics, advertising or any suitable user-specific or global information that can be used by electronic media device 1000. Storage device 1050 can also store programs or applications that can run on control circuitry 1030, can maintain files formatted to be read and edited by one or more of the applications and can store any additional files that can aid the operation of one or more applications (e.g., files with metadata). It should be understood that any of the information stored on storage device 1050 can instead be stored in memory 1045.

Electronic media device 1000 can also include input component 1020 and output component 1025 for providing a user with the ability to interact with electronic media device 1000. For example, input component 1020 and output component 1025 can provide an interface for a user to interact with an application running on control circuitry 1030. Input component 1020 can take a variety of forms, such as a keyboard/keypad, trackpad, mouse, click wheel, button, stylus or touch screen. Input component 1020 can also include one or more devices for user authentication (e.g., a smart card reader, a fingerprint reader or an iris scanner) as well as an audio input device (e.g., a microphone) or a video input device (e.g., a camera or a web cam) for recording video or still frames. Output component 1025 can include any suitable display, such as a liquid crystal display (LCD) or a touch screen display, a projection device, a speaker or any other suitable system for presenting information or media to a user. Output component 1025 can be controlled by graphics circuitry 1035. Graphics circuitry 1035 can include a video card, such as a video card with 2D, 3D or vector graphics capabilities. In some embodiments, output component 1025 can also include an audio component that is remotely coupled to electronic media device 1000. For example, output component 1025 can include a headset, headphones or ear buds that can be coupled to electronic media device 1000 with a wire or wirelessly (e.g., Bluetooth headphones or a Bluetooth headset).

Electronic media device 1000 can have one or more applications (e.g., software applications) stored on storage device 1050 or in memory 1045. Control circuitry 1030 can be configured to execute instructions of the applications from memory 1045. For example, control circuitry 1030 can be configured to execute a media player application that causes full-motion video or audio to be presented or displayed on output component 1025. Other applications resident on electronic media device 1000 can include, for example, a telephony application, a GPS navigator application, a web browser application and a calendar or organizer application. Electronic media device 1000 can also execute any suitable operating system, such as Mac OS, Apple iOS, Linux or Windows and can include a set of applications stored on storage device 1050 or memory 1045, which applications can be compatible with the operating system running on the device.

In some embodiments, electronic media device 1000 can also include communications circuitry 1055 to connect to one or more communications networks. Communications circuitry 1055 can be any suitable communications circuitry operative to connect to a communications network and to transmit communications (e.g., voice or data) from electronic media device 1000 to other devices within the communications network. Communications circuitry 1055 can be operative to interface with the communications network using any suitable communications protocol such as, for example, Wi-Fi (e.g., a 802.11 protocol), Bluetooth, high frequency systems (e.g., 900 MHz, 2.4 GHz and 5.6 GHz communication systems), infrared, GSM, GSM plus EDGE, CDMA, quadband and other cellular protocols, VOIP or any other suitable protocol.

In some embodiments, communications circuitry 1055 can be operative to create a communications network using any suitable communications protocol. Communications circuitry 1055 can create a short-range communications network using a short-range communications protocol to connect to other devices. For example, communications circuitry 1055 can be operative to create a local communications network using the Bluetooth protocol to couple with a Bluetooth headset (or any other Bluetooth device). Communications circuitry 1055 can also include a wired or wireless network interface card (NIC) configured to connect to the Internet or any other public or private network. For example, electronic media device 1000 can be configured to connect to the Internet via a wireless network, such as a packet radio network, an RF network, a cellular network or any other suitable type of network. Communication circuitry 1045 can be used to initiate and conduct communications with other communications devices or media devices within a communications network.

Electronic media device 1000 can also include any other component suitable for performing a communications operation. For example, electronic media device 1000 can include a power supply, an antenna, ports or interfaces for coupling to a host device, a secondary input mechanism (e.g., an ON/OFF switch) or any other suitable component.

Speaker driver circuitry 1060 can include circuitry configured to convert audio signals to signals that are configured to drive one or more piezoelectric speakers 1005. In some embodiments piezoelectric speakers 1005 can be driven with a varying voltage, however other types of signals can be used. In various embodiments speaker driver circuitry can separate a higher frequency band from a lower frequency band and send the higher frequencies to a first piezoelectric speaker and the lower frequencies to a second piezoelectric speaker. Other configurations and variations of speaker driver circuitry 1060 and piezoelectric speaker 1005 are within the scope of this disclosure.

Although the electronic devices (e.g., electronic device 100 in FIG. 1) are described and illustrated as one particular electronic device, embodiments of the disclosure are suitable for use with a multiplicity of electronic devices. For example, any device that receives or transmits audio, video or data signals can be used with the disclosure. In some instances, embodiments of the disclosure are particularly well suited for use with portable electronic media devices because of their potentially small form factor. As used herein, an electronic media device includes any device with at least one electronic component that can be used to present human-perceivable media. Such devices can include, for example, portable music players (e.g., MP3 devices and Apple's iPod devices), portable video players (e.g., portable DVD players), cellular telephones (e.g., smart telephones such as Apple's iPhone devices), watches, wearable electronic devices, video cameras, digital still cameras, projection systems (e.g., holographic projection systems), gaming systems, PDAs, as well as tablet (e.g., Apple's iPad devices), laptop or other mobile computers. Some of these devices can be configured to provide audio, video or other data or sensory output.

For simplicity, various internal components, such as the control circuitry, graphics circuitry, bus, memory, storage device and other components of electronic devices are not shown in the figures.

In the foregoing specification, embodiments of the disclosure have been described with reference to numerous specific details that can vary from implementation to implementation. The specification and drawings are, accordingly, to be regarded in an illustrative rather than a restrictive sense. The sole and exclusive indicator of the scope of the disclosure, and what is intended by the applicants to be the scope of the disclosure, is the literal and equivalent scope of the set of claims that issue from this application, in the specific form in which such claims issue, including any subsequent correction. The specific details of particular embodiments can be combined in any suitable manner without departing from the spirit and scope of embodiments of the disclosure.

Additionally, spatially relative terms, such as "bottom or "top" and the like may be used to describe an element and/or feature's relationship to another element(s) and/or feature(s) as, for example, illustrated in the figures. It will be understood that the spatially relative terms are intended to encompass different orientations of the device in use and/or operation in addition to the orientation depicted in the figures. For example, if the device in the figures is turned over, elements described as a "bottom" surface may then be oriented "above" other elements or features. The device may be otherwise oriented (e.g., rotated 90 degrees or at other orientations) and the spatially relative descriptors used herein interpreted accordingly.

What is claimed is:

1. An electronic device comprising:

a housing including a transparent cover attached to a housing body having a rear portion and a plurality of sidewalls extending between the rear portion and the transparent cover;

an opening formed through the transparent cover;

a piezoelectric speaker diaphragm disposed within the opening and positioned to be substantially coplanar with an exterior surface of the transparent cover;

a piezoelectric receiver attached to the speaker diaphragm; and a vibration isolator coupled between the piezoelectric speaker diaphragm and the transparent cover to enable the piezoelectric speaker diaphragm to vibrate independently from the transparent cover.

2. The electronic device of claim 1 wherein the vibration isolator is disposed around a periphery of the speaker diaphragm and is configured to create a water tight seal between the speaker diaphragm and the transparent cover.

3. The electronic device of claim 1 wherein the piezoelectric speaker diaphragm is coplanar with and colored to match the exterior surface of the transparent cover such that it appears to be a portion of the transparent cover.

4. The electronic device of claim 3 wherein the piezoelectric speaker diaphragm is made from a transparent material.

5. The electronic device of claim 4 wherein the transparent cover is made from glass.

6. The electronic device of claim 1 further comprising circuitry operatively coupled to the piezoelectric receiver and configured to cause the piezoelectric speaker diaphragm to vibrate and function as a speaker.

7. The electronic device of claim 1 comprising a plurality of piezoelectric speakers used together as an aggregate speaker.

8. The electronic device of claim 1 wherein the piezoelectric speaker diaphragm is transparent and is similar in appearance to the transparent cover.

9. The electronic device of claim 1 wherein the transparent cover extends between the plurality of sidewalls.

10. The electronic device of claim 1 wherein the transparent cover includes a display region separate from a speaker region and the opening is formed through the transparent cover in the speaker region.

11. An electronic device comprising:

a transparent cover disposed over a graphical display of the electronic device, the transparent cover having an opening formed there through;

a housing body having a rear portion and a plurality of sidewalls extending between the rear portion and the transparent cover;

a piezoelectric speaker aligned with the opening, the piezoelectric speaker including a speaker diaphragm and a piezoelectric receiver attached to the speaker diaphragm, wherein the speaker diaphragm is substantially coplanar with an exterior surface of the transparent cover; and a vibration isolator coupled between the speaker diaphragm and the transparent cover to enable the speaker diaphragm to vibrate independently from the transparent cover.

12. The electronic device of claim 11 wherein the speaker diaphragm is made from a transparent material.

13. The electronic device of claim 11 wherein the piezoelectric receiver includes a layer of piezoelectric material bonded to the speaker diaphragm.

14. The electronic device of claim 13 further comprising circuitry operatively coupled to the piezoelectric receiver and configured to cause the speaker diaphragm to vibrate and function as a speaker.

15. The electronic device of claim 11 wherein the vibration isolator is arranged to cover a gap between the speaker diaphragm and the transparent cover creating a water tight seal between the speaker diaphragm and the transparent cover.

16. The electronic device of claim 11 wherein there are a plurality of vibration isolators that are disposed around a periphery of the speaker diaphragm.

17. The electronic device of claim 11 wherein there are a plurality of speakers, each aligned with an opening within the transparent cover.

18. An electronic device comprising:

a housing including a transparent cover attached to a housing body having a rear portion and a plurality of sidewalls extending between the rear portion and the transparent cover;

an opening formed through the transparent cover;

a piezoelectric speaker aligned with the opening and including a speaker diaphragm and a piezoelectric receiver attached to the speaker diaphragm, wherein the speaker diaphragm is positioned to be substantially coplanar with an exterior surface of the transparent cover;

a speaker driver circuit configured to transmit electronic signals to the piezoelectric receiver that make the speaker diaphragm vibrate; and a vibration isolator coupled between the speaker diaphragm and the transparent cover to enable the speaker diaphragm to vibrate independently from the transparent cover.

19. The electronic device of claim 18 wherein the vibration isolator is arranged to cover a gap between the speaker diaphragm and the housing creating a water tight seal between the speaker diaphragm and the housing.

20. The electronic device of claim 18 wherein the speaker diaphragm is colored to match the exterior surface of the transparent cover such that it appears to be a portion of the transparent cover.

21. The electronic device of claim 20 wherein the speaker diaphragm is made from a transparent material.

22. The electronic device of claim 21 wherein the transparent cover is made from glass.

23. The electronic device of claim 18 wherein there are a plurality of speakers, each aligned with an opening within the transparent cover.

* * * * *